US005774902A

United States Patent [19]

Gehse

[11] Patent Number: 5,774,902

[45] Date of Patent: Jul. 7, 1998

[54] PROTECTION SUIT

[75] Inventor: Hartmut Gehse, Markdorf, Germany

[73] Assignee: SD & E System Design & Engineering GmbH, Friedrichshafen, Germany

[21] Appl. No.: 766,304

[22] Filed: Dec. 13, 1996

[30] Foreign Application Priority Data

Dec. 20, 1995 [DE] Germany ..... 195 47 795.2

[51] Int. Cl.[6] ..... A62B 17/00

[52] U.S. Cl. ..... 2/458; 2/2.14; 2/DIG. 1

[58] Field of Search ..... 2/2.14, 457, 458, 2/2.11, 97, 171.3, DIG. 1, DIG. 3; 428/156, 159, 171

[56] References Cited

U.S. PATENT DOCUMENTS

| | | | |
|---|---|---|---|
| 3,049,896 | 7/1962 | Webb | 2/458 |
| 3,345,236 | 10/1967 | Copeland | 2/458 |
| 3,559,642 | 2/1971 | Cupp . | |
| 3,710,395 | 1/1973 | Spano et al. . | |
| 3,743,012 | 7/1973 | Laxo . | |
| 4,172,454 | 10/1979 | Warncke et al. | 2/457 |
| 5,063,923 | 11/1991 | Peroni . | |
| 5,243,706 | 9/1993 | Frim et al. | 2/458 |

FOREIGN PATENT DOCUMENTS

| | | |
|---|---|---|
| 0 490 347 A1 | 6/1992 | European Pat. Off. . |
| 28 46 139 | 12/1982 | Germany . |
| 37 21 736 | 1/1989 | Germany . |
| WO 83/02562 | 8/1983 | WIPO . |
| WO 92/17079 | 10/1992 | WIPO . |

*Primary Examiner*—C. D. Crowder
*Assistant Examiner*—Larry D. Worrell, Jr.
*Attorney, Agent, or Firm*—Anthony J. Casella; Gerald E. Hespos; Ludomir A. Budzyn

[57] ABSTRACT

A special-purpose suit is provided, in particular for pilots or vehicle drivers or other individuals whose bodies need to be protected, having an outer protective layer which protects against undesirable external influences, a moisture-permeable and/or vapor-permeable inner layer, and a space-maintaining, fluid-permeable spacer layer which is arranged between the outer protective layer and the inner layer and can be climatically conditioned with the introduction of a fluid, the protective layer, the inner layer and the spacer layer being designed such that they essentially cover the torso and/or the leg and/or the arm areas of the special-purpose suit.

20 Claims, 3 Drawing Sheets

PROTECTION SUIT

BACKGROUND OF THE INVENTION

1. Field of the Invention

The present invention relates to a special-purpose suit, in particular for pilots or vehicle drivers or other individuals whose bodies need to be protected, having an outer protective layer which protects against undesirable external influences, and a moisture-permeable and/or vapor-permeable inner layer.

2. Description of the Prior Art

Known protective suits provide insulation against heat and cold, but, when used for a prolonged period of time under extreme conditions or in emergency situations—e.g. a worker on an oil rig in bad weather conditions, a fire fighter in direct contact with the flames or a pilot in water—lead to rapid cooling or heating-up, this hindering or limiting the endurance of the person wearing the special-purpose suit, the period over which he or she can remain physically active, or his or her chances of survival.

It is, furthermore, known to use special protective suits to insulate and shield a person from the exterior surroundings, as this person carries out special tasks, by the provision of foils or sheets, non-flammable fibers, armoring, etc. However, the disadvantage with these known protective suits is that they hinder the natural regulation of the body heat and metabolic functions, because the foils or sheets, non-flammable fibers, armoring, etc. do not have the normal climatic properties of conventional clothing. The impaired heat exchange, in particular the lower evaporative transmission of heat, thus results in an increase in the average body temperature and sweating (dehydration). Accordingly, this reduces the endurance of the person wearing the special-purpose suit and the period for which he or she can remain physically active and prejudices his or her safety, in particular due to the lack of concentration and endurance.

The object of the present invention is thus to provide an improved special-purpose suit, in particular for pilots, which is insulated against undesirable external influences, while simultaneously maintaining normal climatic properties in the interior of the special-purpose suit, and provides a space-maintaining, elastic and heat-insulating function, in particular in high-acceleration phases or high-deceleration phases or in different pressure conditions.

SUMMARY OF THE INVENTION

According to the invention, a special-purpose suit or protective suit, in particular for pilots or vehicle drivers or other individuals whose bodies need to be protected, comprises an outer protective layer which protects against undesirable external influences, a moisture-permeable and/or vapor-permeable inner layer, and a space-maintaining, fluid-permeable spacer layer which is arranged between the outer protective layer and the inner layer and can be climatically conditioned with the introduction of a fluid, the protective layer, the inner layer and the spacer layer being designed such that they essentially cover the torso and/or the leg and/or the arm areas of the special-purpose suit.

The invention provides body-enclosing, enforced spacing in a special-purpose suit or special-purpose clothing in order to ensure the formation of an interspace between the body and the protective layer, by way of which interspace the basic insulation is increased and through which interspace a fluid or medium can flow without resistance. Climatic conditioning (in particular in terms of temperature, moisture and/or pressure) close to the body can be achieved, in particular, by conditioning of the fluid.

This thus provides a microclimate which is close to the body and ensures the dissipation of the heat and moisture which the body releases. The climatic conditioning close to the body thus provides relief for the body of the wearer, in particular by the direct heat and moisture exchange adapted to the body, and increases the capacity for physical activity and endurance of the wearer.

Furthermore, according to the invention, the body-enclosing spacer layer improves the basic insulation, in particular by minimizing the heat bridges and by the lower heat conduction of the medium or fluid itself.

According to the invention, the spacer layer comprises an elastic lattice with a flexible and compression-resistant, space-maintaining knitted fabric and/or woven fabric of interlinked plastic yarns.

Furthermore, providing a slight overpressure in the spacer layer hinders contamination by the penetration of contaminants. It is, furthermore, possible to provide in particular in the outer protective layer, layers which bind penetrating contaminants, this reducing the risk of contamination. In a preferred embodiment, fluid can pass through the spacer layer in an essentially coplanar manner.

The knitted fabric is, in particular, a knitted space-maintaining, textile fabric which permits free selection of the spacer-layer thickness and ensures a permanent restoring elasticity and stretchability of the spacer layer.

Furthermore, the knitted fabric and/or woven fabric makes it possible for the special-purpose suit to be designed with a low weight, this ensuring large freedom of movement and reduced strain to the wearer.

The spacer layer is particularly preferably divided up into at least two separate fluid regions, preferably different microclimates being produced in the at least two fluid regions, and sealing means preferably being arranged between the fluid regions.

Furthermore, the spacer layer preferably extends along the leg areas and/or the arm areas and/or the hand areas and/or the pelvic area and/or the abdominal area and/or the chest area and/or the area of the back.

According to a further preferred embodiment, the spacer layer is subdivided at least partially into fluid-connected sublayers which enclose annularly predetermined areas of the body.

The structure is preferably an elastic lattice structure of interconnected yarns, the spacer layer preferably comprising yarns, in particular of plastic, which are interlinked in the manner of cells.

In addition, furthermore at least one fluid connection or inlet is preferably provided for the connection of the special-purpose suit to a climate-conditioning device, in order to permit enforced climatic conditioning of the spacer layer, the fluid contained or present or arising in the spacer layer preferably being isolated fluidically from the exterior surroundings.

Furthermore, an additional space-maintaining, fluid-permeable spacer layer is preferably provided in the area of the head, in particular between the outer protective layer and the head.

According to a further embodiment of the present invention, the spacer layer is of a different thickness, preferably thicker, in certain areas.

The spacer layer is preferably thicker in the area of the back and/or in the area of the bottom and/or the pelvic area and/or the shoulder area than in the other areas, the spacer layer preferably being as thick to twice as thick in the area of the back and/or the area of the bottom and/or the pelvic area and/or the shoulder area as in the other areas.

According to a preferred embodiment, the spacer layer has a thickness of from approximately 3 to approximately 20 mm, preferably from approximately 5 to approximately 15 mm and particularly preferably from approximately 6 to approximately 13 mm in the area of the back and/or the area of the bottom and/or the pelvic area and/or the shoulder area.

BRIEF DESCRIPTION OF THE DRAWINGS

Preferred embodiments of the present invention are described by way of example hereinbelow with reference to the drawing, in which.

DETAILED DESCRIPTION OF THE PREFERRED EMBODIMENTS

Figure 1:
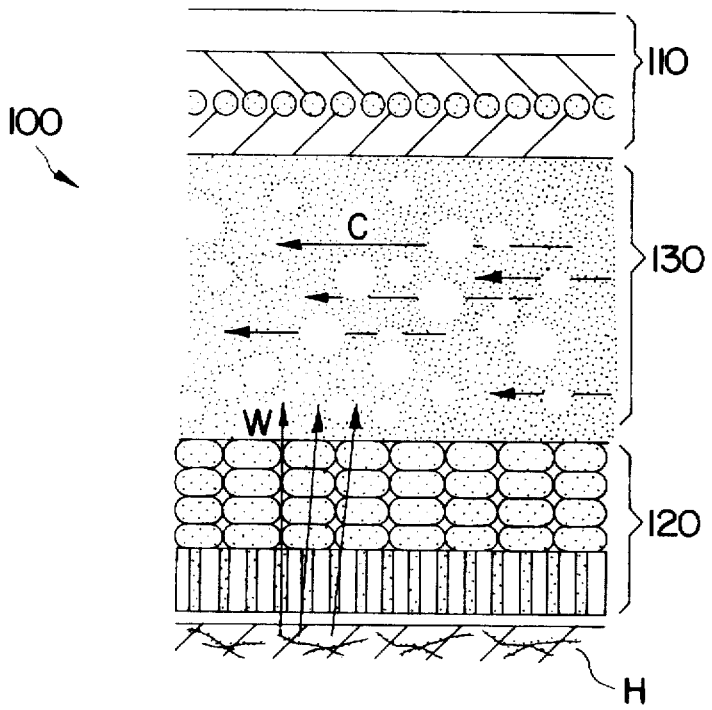
FIG. 1 shows a schematic sectional view of the layers of a preferred embodiment of the special-purpose suit according to the invention.

A preferred embodiment of the special-purpose suit according to the invention comprises a multi-layered woven fabric 100 shown in FIG. 1.

The multi-layered woven fabric 100 comprises an outer protective layer 110 which protects against undesirable external influences, e.g. against a naked flame, extreme cold and/or against toxic surroundings. The outer protective layer 110 may be formed, in particular, from a plurality of layers which are insulated against individual external influences, i.e., for example, from a heat-deflecting layer, a liquid-impermeable layer, a cold-insulating layer, a gas-impermeable layer, a radiation-impermeable layer and/or a layer which ensures ballistic protection, in particular against bullets and material fragments.

The multi-layered woven fabric 100 further comprises an inner layer 120 which lies, in particular, next to the skin H of the person wearing the special-purpose suit, it also being possible for the inner layer 120 to comprise, in particular, textile undergarments. The inner layer 120 is moisture-permeable, in particular permeable to water vapor, in order to permit perspiration or sweat of the person wearing the suit to penetrate into the multi-layered woven fabric 100 from the inside (in a direction W in FIG. 1), it being possible for the inner layer 120 to be preferably of the type which transports moisture or sweat away from the skin H of the person wearing the suit, stores it for an interim period and discharges it to the fluid in the spacer layer 130 for climatic conditioning.

The multi-layered woven fabric 100 further comprises, between the outer protective layer 110 and the inner layer 120, a spacer layer 130. The spacer layer 130 may comprise a knitted space-maintaining textile fabric of natural and/or synthetic fibers which has yarns which are interlinked or interconnected in the manner of cells. The knitted space-maintaining fabric has, in particular, interconnected, fluid-permeable channels which are arranged in a coplanar manner (in a direction C in FIG. 1) with respect to the spacer layer 130 and ensure that a fluid flows through the spacer layer 130 in a coplanar manner, in particular. The fluid can thus pick up, and lead to the outside, moisture which the body releases. The recovery and space-maintaining properties and compressive strength of the spacer layer 130 further ensure that the fluid-permeable channels are not interrupted, even if the spacer layer 130 is subjected to loading by the weight of the person wearing the special-purpose suit 10 and/or by external forces. The spacer 130 may be adhesively bonded to the inner layer 120 and/or the outer layer 110 and/or may be attached thereto, in particular, by means of a touch-and-close fastener or attachment.

Depending on the area of the body in which it is arranged, the spacer layer 130 may be of different thicknesses. In particular in the case of protective suits for pilots, it is advantageous for the spacer layer to be thicker in the area of the back and/or the rear pelvic area than in the other areas of the body, the spacer layer 130 preferably being from approximately 5 to approximately 15 mm, preferably approximately 6 to 13 mm in the area of the back and/or the rear pelvic area, whereas it has a thickness of approximately 6 mm in the other areas. The transitions between areas of increased spacer-layer thickness and the areas with normal spacer-layer thickness preferably take place continuously, so that the person wearing the special-purpose suit 10 cannot feel any edges or "steps".

Figure 2:
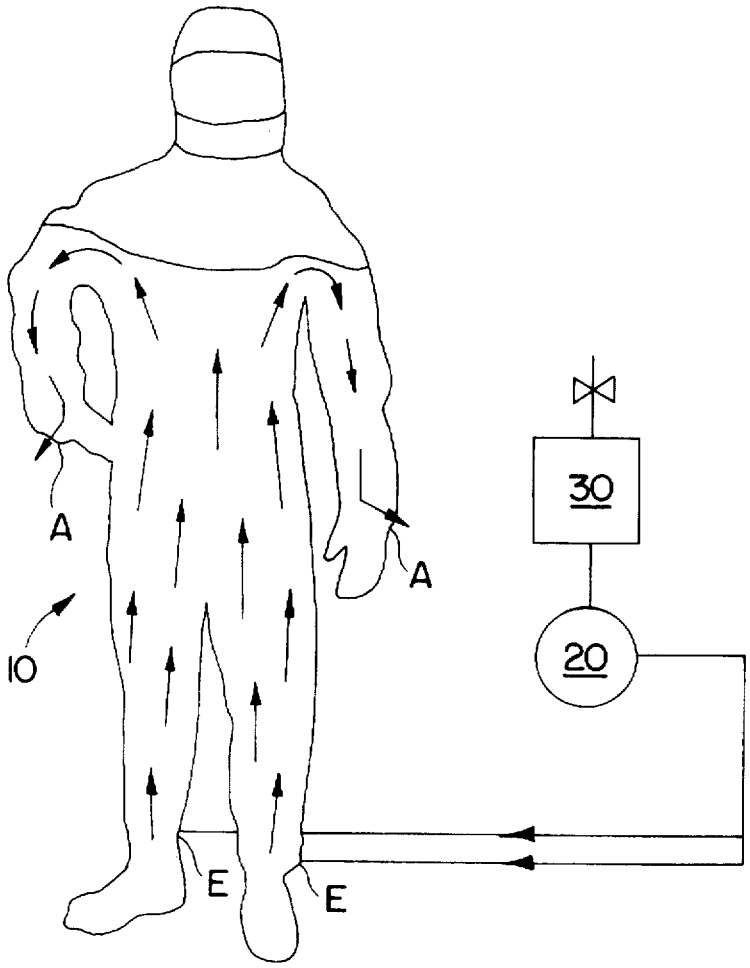
FIG. 2 shows a schematic view of a first embodiment of the special-purpose suit according to the invention.

The special-purpose suit 10 shown in FIG. 2 preferably comprises the multi-layered woven fabric 100 in FIG. 1. The special-purpose suit 10 has an inlet E and an outlet A, which are connected fluidically to the fluid-permeable spacer layer 130, which essentially covers the entire body, respectively for the purpose of admitting a fluid into the spacer layer 130 and for discharging a fluid out of the spacer layer 130. The fluid, in particular air and/or helium, is climatically conditioned by a climate-conditioning device 20, it being possible, in particular, for its temperature, moisture, pressure and/or chemical composition to be regulated or controlled or set, and is introduced into the spacer layer 130 through the inlet E. The fluid preferably flows around various areas of the body and is discharged out of the spacer layer 130 through the outlet A. It is possible, in particular, to provide various outlets A and/or various inlets E and the spacer layer 130 may be divided up into fluidically separate subregions, it being possible for these various subregions to be sealed off or separated from one another by sealing means. By providing various, separate fluid subregions, different microclimates can be produced by one or more climate-conditioning devices 20, and these microclimates permit, in particular, adaptation to external conditions. It is thus possible, in particular, to provide protective suits which are suitable for increased-acceleration applications (e.g. for fighter pilots) and/or reduced-acceleration applications (μg-applications, for example for astronauts), since these suits make it possible, by locally increasing or reducing pressure, to achieve vasoconstriction or a constriction of blood vessels, which prevents blood draining, for example, into the leg area in the event of increased acceleration.

The fluid supplied to the climate-conditioning device 20 may be contained in a receiving vessel or device 30 and/or may be taken from the surroundings.

Figure 3:
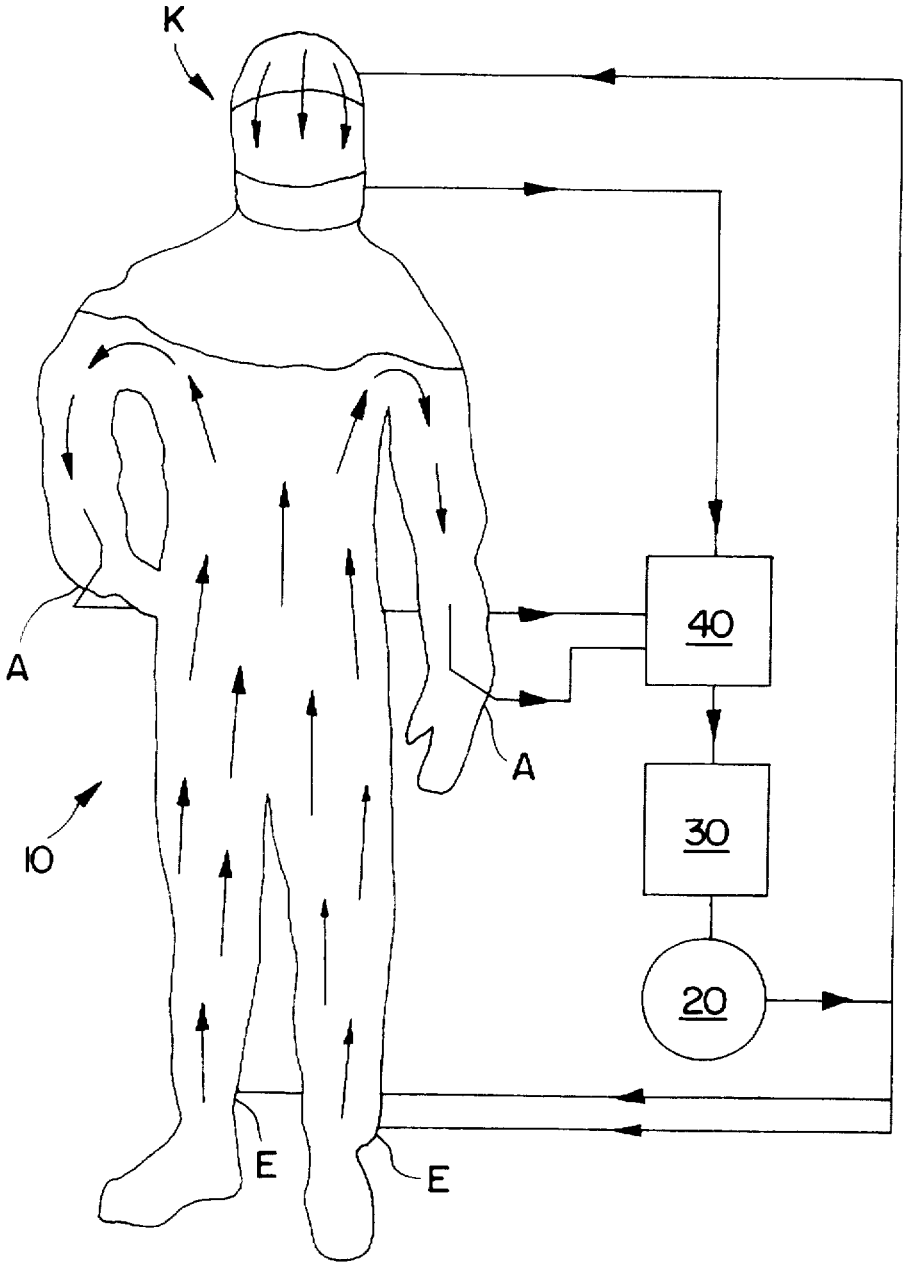
FIG. 3 shows a diagrammatic view of a second embodiment of the special-purpose suit according to the invention.

In the special-purpose suit 10 shown in FIG. 3, the outlet A is re-connected to the receiving vessel 30 via a conditioning device 40. The fluid flowing out of the spacer layer 130 through the outlet A is supplied, via lines, to a conditioning device 40 which conditions the fluid, in particular by removing moisture, filtering substances and/or particles and adding further substances, etc.

The special-purpose suit 10 shown in FIG. 3 thus has a separate, independent circuit which can be separated in its entirety from the surroundings, this vastly reducing, in particular, the risk of contamination.

Furthermore, the special-purpose suit 10 shown in FIG. 3 comprises an additional spacer layer in the area of the head K. This additional spacer layer is arranged, in particular between an outer protective layer, in particular an outer plastic shell, and the head or the surface of the head or the scalp and permits additional climatic conditioning of the area of the head and/or the supply of respiratory air or gas. The fluid supplied to the area of the head K may be climatically conditioned in a climate-conditioning device 20 identical to that used for the other areas of the body, or it may be conditioned by a separate system. Preferably, the fluid which flows into the area of the head K is resupplied to the climate-conditioning device 20 via a conditioning device 40.

The climate-conditioning device 20, the receiving vessel 30 and/or the conditioning device 40 may be arranged within and/or outside the special-purpose suit 10. Furthermore, the spacer layer 130 may be completely self-contained and serve merely for insulation, specifically without enforced climatic conditioning having to take place. This can be achieved, in particular, by providing a self-closing inlet E and a self-closing outlet A, said inlet and outlet closing of their own accord when they are separated from the corresponding lines, so that the spacer layer 130 is "closed off" and separated from the surroundings. This is advantageous, in particular, for protective suits for pilots, which are separated from the climate-conditioning device 20, in particular, in emergency situations (e.g. when the ejector seat is actuated), so that "passive" insulation or basic insulation is, advantageously, made possible by providing an insulating air or fluid layer within the spacer layer. Accordingly, the special-purpose suit 10 provides increased insulation, e.g. against cooling, if a pilot lands in the water following an emergency evacuation. Furthermore, penetration of, for example, air or water into the spacer layer 130 is prevented.

In addition, the spacer layer 130 may be thicker in certain areas in order that a person who is wearing the special-purpose suit 10 and is in the water can be brought into a stable floating position, even if, in particular, he or she is unconscious. The increased thickness of the spacer layer, e.g. in the chest and shoulder areas, results in a larger overall volume per unit area of the spacer layer 130 in said chest and shoulder areas, so that, if air or a fluid with a lower density than the water density is introduced into the spacer layer 130, said chest and shoulder areas are subject to pronounced buoyancy and thus bring the person into a stable and secure floating position.

Accordingly, the special-purpose suit or protective suit is particularly suitable for use by divers, firefighters, oil-rig workers, in particular also for the protection of the latter en route to the oil rig (e.g. in a helicopter), motorcyclists, surfers, police or members of a special task force etc., the special-purpose suit protecting the wearer against external influences and ensuring the climatic conditioning, in particular basic insulation, of the wearer.

What is claimed is:

1. A special-purpose suit for individuals whose bodies need to be protected, said suit to be applied adjacent skin of the body to be protected, said suit comprising:

an outer protective layer (110) which protects against undesirable external influences, a skin-engaging moisture-permeable and vapor-permeable textile inner layer (120) for accommodating transmission of perspiration from the skin through the inner layer and toward the outer layer, and a space-maintaining, fluid-permeable spacer layer (130) adjacent to and between the outer protective layer (110) and the inner layer (120) and being climatically conditionable by the introduction of fluid, the spacer layer (13) being an elastic structure formed by a flexible, compression-resistant, space-maintaining fabric containing interlinked plastic yarns, said spacer layer accommodating a flow of said perspiration and the introduced fluid between the inner and outer layers and away from the body.

2. The special-purpose suit as claimed in claim 1, the spacer layer (130) being divided up into at least two separate fluid regions corresponding to different portions of the body.

3. A special-purpose suit for individuals whose bodies need to be protected, said suit comprising:

an outer protective layer which protects against undesirable external influences, a moisture-permeable and vapor-permeable inner layer, and a space-maintaining, fluid-permeable spacer layer arranged between the outer protective layer and the inner layer and being climatically conditionable by the introduction of fluid, the spacer layer being an elastic structure which is formed by a flexible, compression-resistant, space-maintaining fabric containing interlinked plastic yarns, wherein the spacer layer is divided into at least two separate fluid regions with different microclimates being produced in the at least two fluid regions, and wherein sealing means being arranged between the fluid regions.

4. A special-purpose suit for individuals whose bodies need to be protected, said suit comprising:

an outer protective layer which protects against undesirable external influences, a moisture-permeable and vapor-permeable inner layer, and a space-maintaining, fluid-permeable spacer layer disposed between the outer protective layer and the inner layer and being climatically conditionable by an introduction of fluid, the spacer layer being an elastic structure formed by a flexible, compression-resistant, space-maintaining fabric containing interlinked plastic yarns, wherein the spacer layer is thicker in certain areas than in other areas.

5. The special-purpose suit as claimed in claim 1, the spacer layer (130) being subdivided at least partially into fluid-connected sublayers which enclose annularly predetermined areas of the body.

6. The special purpose suit as claimed in claim 1, further comprising at least one fluid inlet (E) being provided for the connection of the special-purpose suit to a climate-conditioning device (20), in order to permit enforced climatic conditioning of the spacer layer (130), and the fluid contained in the spacer layer (130) being isolated fluidically from the exterior surroundings.

7. The special-purpose suit as claimed in claim 1, an additional space-maintaining, fluid-permeable spacer layer being provided in the area of the head (k) between the outer protective layer and the head.

8. The special-purpose suit as claimed in claim 4, wherein the thicker areas of the spacer layer (130) are up to twice as thick as remaining areas of the spacer layer (130).

9. The special-purpose suit as claimed in claim 8, wherein the thicker areas of the spacer layer (130) define a thickness of approximately 3 to approximately 20 mm.

10. The special-purpose suit as claimed in claim 9, wherein the spacer layer (130) has a thickness of approximately 5 to approximately 15 mm.

11. The special-purpose suit as claimed in claim 10, wherein the spacer layer (130) has a thickness of approximately 6 to approximately 13 mm.

12. The special-purpose suit as claimed in claim 4, wherein the thicker area is disposed at least in a back area and a pelvic area.

13. The special-purpose suit as claimed in claim 12, wherein the thicker area is further disposed in a bottom area of the suit.

14. The special-purpose suit as claimed in claim 13, wherein the thicker area is disposed in a shoulder portion of the suit.

15. The special-purpose suit as claimed in claim 1, wherein the suit includes leg areas, the spacer layer (130) extending along the leg areas.

16. The special-purpose suit as claimed in claim 15, wherein the suit includes arm areas, the spacer layer (130) extending along the arm areas.

17. The special-purpose suit as claimed in claim 16, wherein the suit includes a pelvic area, the spacer layer (130) extending along the pelvic area.

18. The special-purpose suit as claimed in claim 17, wherein the suit includes a abdominal area, the spacer layer (130) extending along the abdominal area.

19. The special-purpose suit as claimed in claim 18, wherein the suit includes a chest area, the spacer layer (130) extending along the chest area.

20. The special-purpose suit as claimed in claim 19, wherein the suit includes a back area, the spacer layer (130) extending along the back area.

* * * * *